United States Patent [19]

Adkins et al.

[11] 4,399,871

[45] Aug. 23, 1983

[54] CHEMICAL INJECTION VALVE WITH OPENABLE BYPASS

[75] Inventors: Joel E. Adkins, Carrollton; Gregg W. Stout, Montgomery; Russell A. Johnston, Lewisville, all of Tex.

[73] Assignee: Otis Engineering Corporation, Dallas, Tex.

[21] Appl. No.: 331,251

[22] Filed: Dec. 16, 1981

[51] Int. Cl.[3] ..... E21B 34/00

[52] U.S. Cl. ..... 166/325; 166/321; 137/539.5; 137/70

[58] Field of Search ..... 166/325, 321, 317; 137/539.5, 536, 540, 70, 467; 251/297

[56] References Cited

U.S. PATENT DOCUMENTS

| | | | |
|---|---|---|---|
| 1,896,706 | 2/1933 | Grimes | 137/539.5 |
| 2,726,723 | 12/1955 | Wilhoit et al. | 166/325 |
| 3,993,129 | 11/1976 | Watkins | 137/155 X |
| 4,039,031 | 8/1977 | Crowe | 166/321 X |
| 4,325,431 | 4/1982 | Alkerman | 166/321 X |

*Primary Examiner*—Ernest R. Purser
*Assistant Examiner*—Thuy M. Bui
*Attorney, Agent, or Firm*—Albert W. Carroll

[57] ABSTRACT

A combination well flow control device having a passage therethrough for conducting fluids from the exterior to the interior of the tubing, this device having pressure responsive valve means therein for controlling flow of fluids such as well treating chemicals through the flow passage at very low rates and also having a bypass passage which is initially closed by a sleeve valve but which is openable to permit high injection rates therethrough as for injecting water or the like fluid into the tubing at a very high rate as for killing the well. When the sleeve valve has been moved to bypass opening position, the valve flow passage is short-circuited through the bypass, and in one embodiment that portion upstream of the sleeve valve is shut off. After the sleeve valve has been moved to open position, it will remain at that position. The device also includes a check valve for preventing backflow therethrough regardless of whether the bypass is open or closed.

27 Claims, 11 Drawing Figures

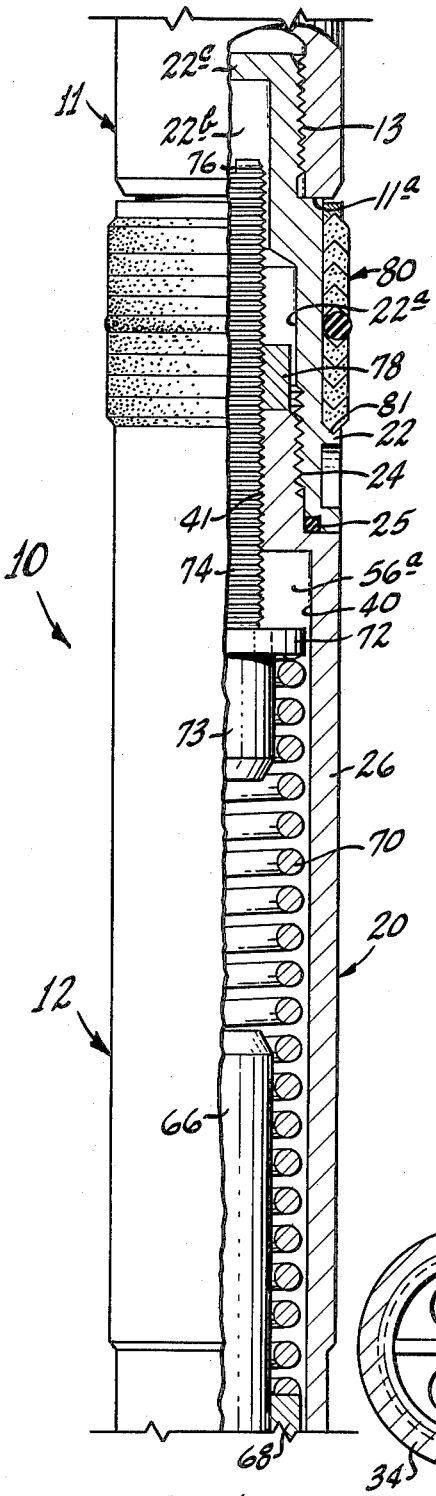
FIG. 1-B
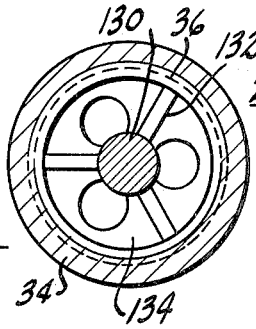
FIG. 2
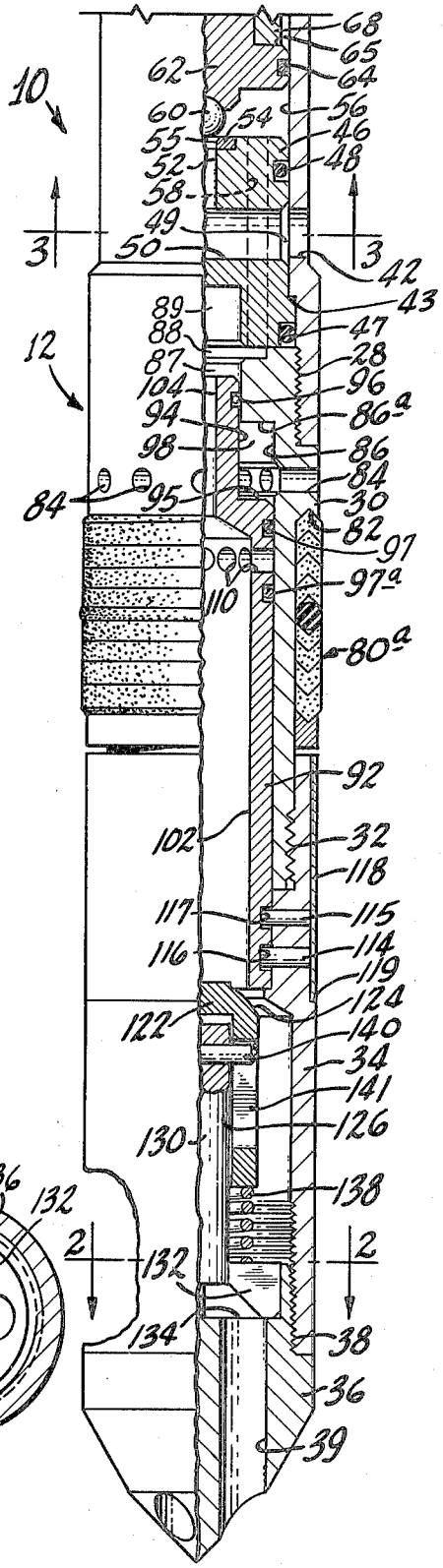
FIG. 1-C

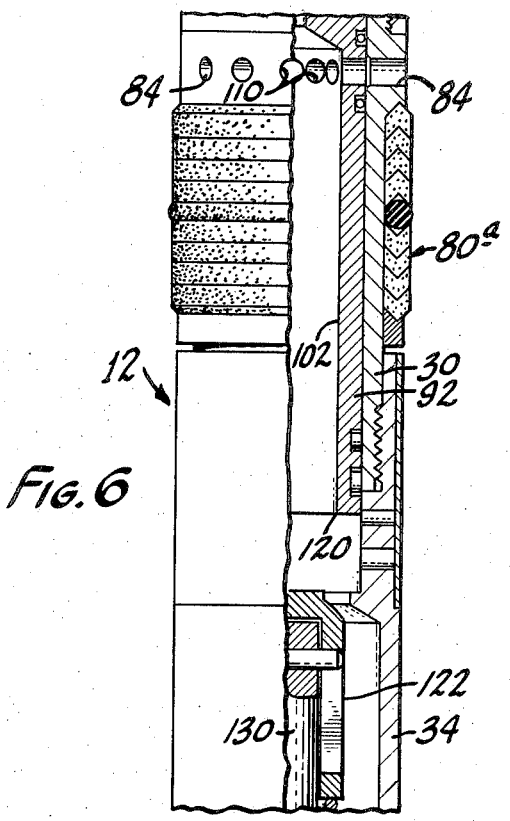
FIG. 6
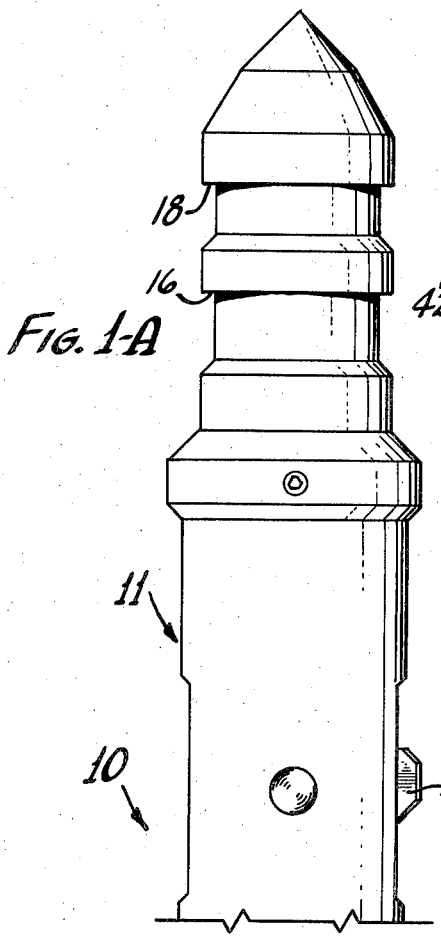
FIG. 1-A
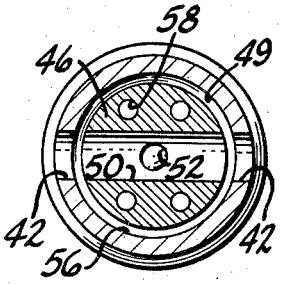
FIG. 3
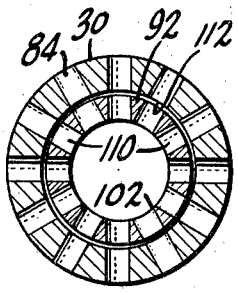
FIG. 5
FIG. 4
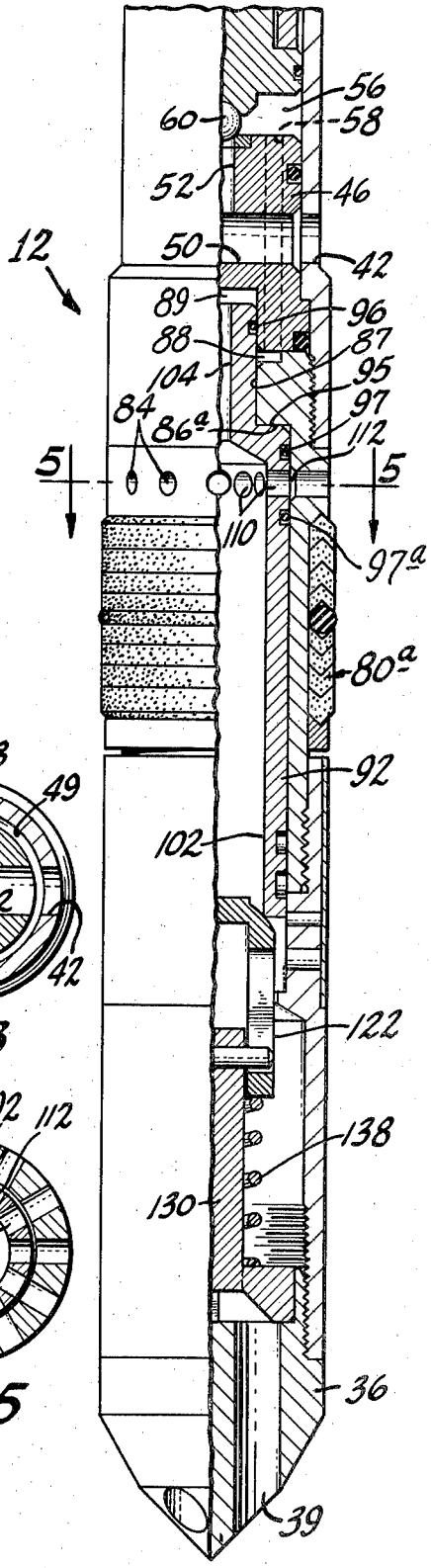

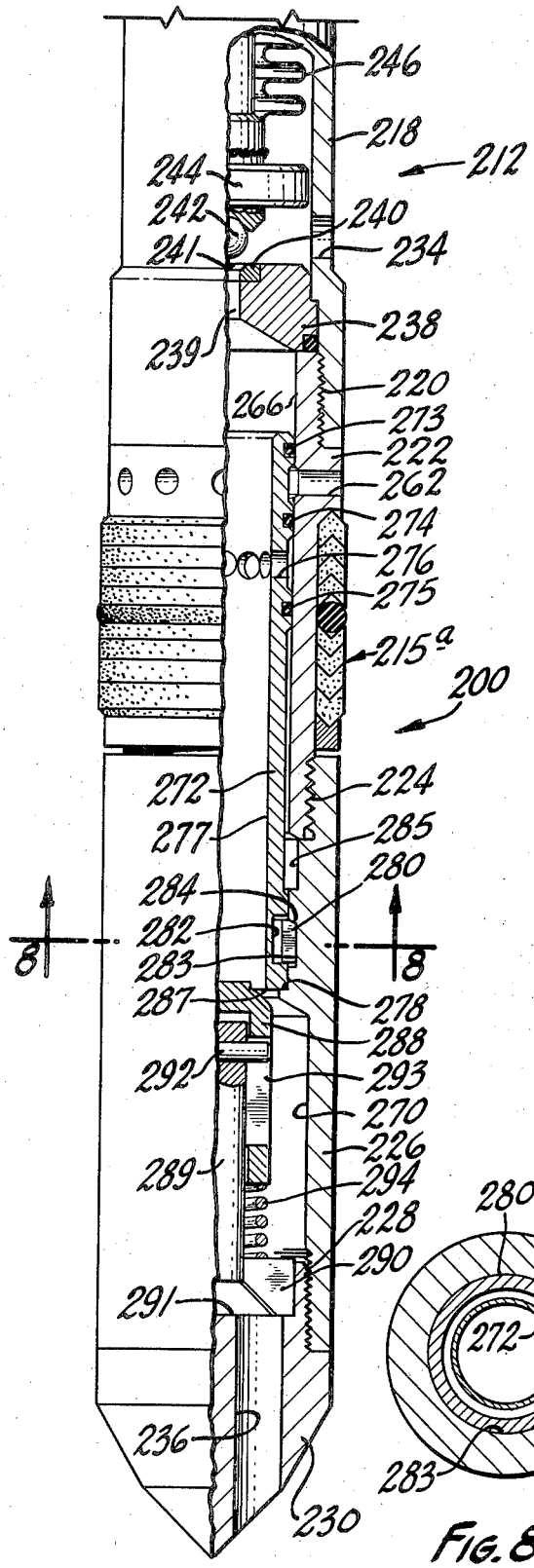
FIG. 7-B
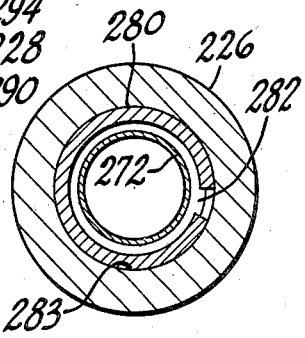
FIG. 8
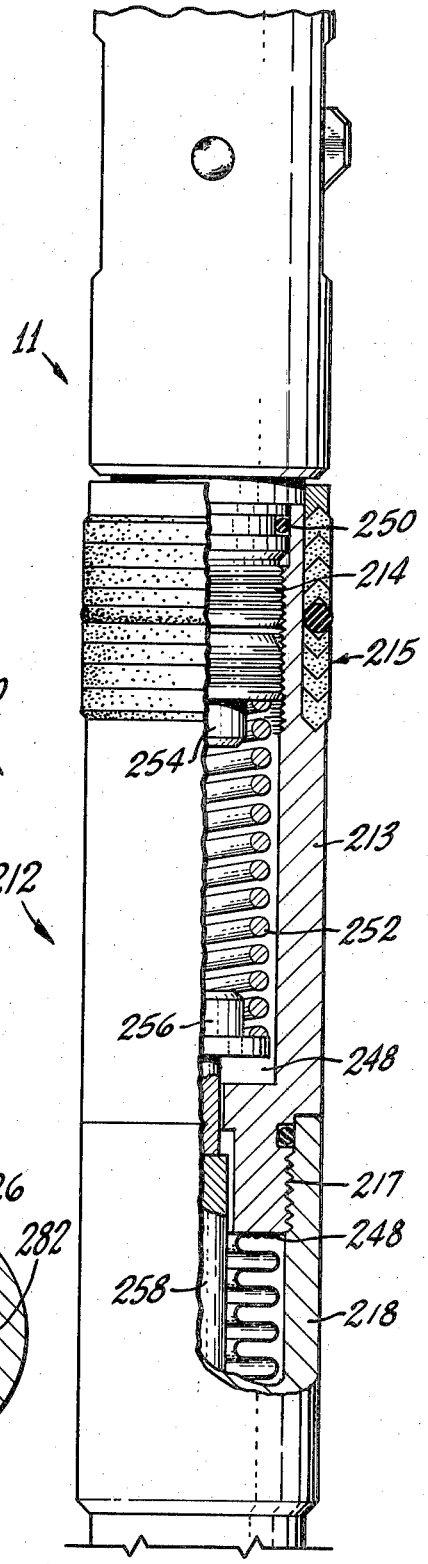
FIG. 7-A

CHEMICAL INJECTION VALVE WITH OPENABLE BYPASS

BACKGROUND OF THE INVENTION

1. Field of the Invention

This invention relates to well tools and more particularly to flow controlling devices, especially devices for controlling injection of treating fluids and kill fluids in wells.

2. Description of the Prior Art

Chemical injection valves have been used for many years in wells for controlling injection of treating fluids into well tubing at subsurface levels, for instance, for purposes of controlling corrosion, deposition of paraffin, and the like. Such valves are generally installed in and removed from receptacles, which form a part of the tubing, through use of wireline equipment and techniques or by through flow line (TFL) methods commonly called "pumpdown" so that such valves can be readily repaired or replaced without removing the tubing from the well.

Also, circulation valves have been used in wells for many years. The tools generally have an openable passage which permits the well to be "killed" or loaded with fluid when necessary.

Further, it is common practice to place such valves in a side pocket mandrel in which an offset receptacle is provided. Thus, such valves do not obstruct flow through the tubing. In addition, other well tools can be moved past them and any one of such valves or other devices can be serviced without disturbing other tools in the tubing.

It is sometimes desirable to inject chemicals or other treating fluids at a very low rate into the tubing of a well through use of a subsurface injection valve during the production phase. Then when it is desired to load the well with kill fluid, it becomes desirable to inject such fluid at a very much higher rate. Since chemical injection valves are designed for very low flow rates, it is very difficult, slow, and costly to kill a well by injecting fluids therethrough.

Examples of chemical injection valves and circulation tools are found in the following U.S. Pat. Nos.:

2,606,616;
2,726,723;
2,962,097;
3,051,243;
3,211,232;
3,871,450;
3,993,129;
4,039,031.

U.S. Pat. No. 3,871,450 issued to Marion B. Jett, et al. on Mar. 18, 1975 for "DUAL STRING CIRCULATING VALVE." This patent shows a sleeve having a pair of bores in which is received a pair of tubular sections forming portions of a pair of tubing strings in a well. This sleeve is initially releasably secured in position covering a circulation port in one of the tubular sections. A second sleeve surrounds the other tubular section and covers a lateral port therein. Pressuring up said one tubular section will lift both sleeves and uncover the circulation ports to permit killing the well by circulating of weighted fluids into it. Pressuring up said other tubular section forces both of the sleeves down to a level below the initial level. In this lowermost position, a pair of o-rings of equal size straddle the circulation ports, in which position the sleeve is latched and cannot be displaced therefrom.

U.S. Pat. No. 4,039,032 issued to Talmadge L. Crowe on Aug. 3, 1977 for "WELL CONTROL VALVE APPARATUS." This patent shows a flow control device for use in the offset receptacle of a side pocket mandrel in a well. It has a body with a flow passage therethrough having one end thereof in communication with the exterior of the tubing and with the other end thereof in communication with the interior of the tubing. Intermediate its ends, there is a rupturable disc sealing the flow passage, and below this, there is a plug sealingly engaged in the flow passage and a flange thereon is engaged with a shoulder in the passage. The plug protects the disc against rupture by pressure applied thereto through the tubing while overpressuring exterior of the tubing will rupture the disc and expel the plug, thus opening the passage for circulation of killing fluids therethrough.

U.S. Pat. No. 2,726,723 issued Dec. 13, 1955 to Lowell M. Wilhoit et al. discloses a chemical injection valve for controlling the entry of treating fluids into the well tubing from the annulus exterior thereof. This valve is installable and removable in the bypass landing nipple shown by well-known wireline methods. Since it occupies the tubing bore, other tools cannot be lowered beyond the landing nipple without first retrieving the chemical injector.

U.S. Pat. No. 2,606,616 issued to Herbert C. Otis on Aug. 12, 1952 and shows a landing nipple forming a part of a tubing string. The nipple has lateral ports and a removable sleeve covers and seals these ports. When the sleeve is removed, flow through the ports can be had for such purposes as circulating treating fluids, etc.

U.S. Pat. No. 3,051,243 issued to George G. Grimmer et al. on Aug. 28, 1962 and discloses a sliding sleeve valve device much like that of Dollison U.S. Pat. No. 2,962,097, supra, but also shows a device for shifting the sleeve.

U.S. Pat. No. 3,211,232 which issued to George G. Grimmer on Oct. 12, 1965 discloses means utilizing pressure applied to the tubing from the surface to expel plugs from the nipple ports to permit circulation of fluids through the ports Afterwards, a ball, or the like, is dropped into the tubing and allowed to settle on expendable shifting means. Pressure then applied above the ball forces the sleeve valve to closed position and the ball and shifter are expended. Any subsequent shifting of the sleeve valve is accomplished in the conventional manner using the device of Grimmer, et al., supra, or the equivalent thereof.

U.S. Pat. No. 2,962,097 issued Nov. 29, 1960 to William W. Dollison and shows a ported nipple for use in well tubing and has a sleeve therein which is shiftable by suitable tools between port-opening and port-closing positions to permit or prevent flow through the ports.

U.S. Pat. No. 3,993,129 which issued to Fred E. Watkins on Nov. 23, 1976 discloses a "FLUID INJECTION VALVE FOR WELLS" which is suitable for use in a side pocket mandrel in a well to control injection of chemicals and other treating fluids into the tubing from the surrounding annulus. Fluids enter the side of this valve, advance to an upwardly opening passage terminating in a valve seat and there acts on the spring biased valve. The fluids lift the valve to exit the seat, then turn and flow back down through an offset passage into the lower portion of the device and out the lower end thereof into the tubing. This is similar to the injection valve mechanism of the present invention.

None of the prior art of which the applicants are aware shows a fluid injection valve for use in a side pocket mandrel in a well to control the flow of fluids from the exterior to the interior of the tubing and having a bypass passage for bypassing the valve mechanism when necessary to circulate large volumes of liquids, the bypass passage being initially closed but being openable in response to the pressure interior of the tubing exceeding that exterior thereof by a predetermined amount.

SUMMARY OF THE INVENTION

The present invention is directed to a well tool for controlling flow of fluids into the tubing from exterior thereof at a downhole location and having initially closed bypass means openable in response to pressure interior of the tubing exceeding the pressure exterior of the tubing by a predetermined amount, this well tool having a housing connectable to the tubing and a flow passage therein extending between inlet and outlet means, an annular seat surrounding the flow passage, a valve engageable with the seat to control flow therethrough, operator means for moving the valve between open and closed positions and responsive to pressure exterior of the tubing exceeding that inside the tubing by a predetermined amount, bypass ports connecting the flow passage with the exterior of the tubing downstream of the annular seat, and a sleeve valve in the housing initially closing the bypass but movable to a position opening such ports when the pressure interior of the tubing exceeds the pressure exterior of the tubing by predetermined amount.

It is an object of this invention to provide a well tool installable in a tubing string for controlling the injection of fluids into the tubing from the region exterior thereof.

Another object is to provide such a well tool which can be installed in and removed from a side pocket mandrel or other suitable receptacle forming a part of the tubing string, this well tool permitting injection of fluids into the tubing when the pressure exterior of the tubing exceeds the pressure interior of the tubing by a predetermined amount.

Another object is to provide a well tool of the character described having a bypass passage therein through which fluids may be circulated at high rates as required, for instance, in killing the well.

A further object is to provide such a well tool having a sleeve valve controlling the bypass passage, the sleeve valve initially being in closed position and being movable to open position on occurrence of a tubing pressure which exceeds the pressure exterior thereof by a predetermined amount.

Another object is to provide a well tool of the character described wherein the sleeve valve controlling the bypass passage has seals of unequal diameters engaging the housing and the difference in the areas sealed by these seals is responsive to the occurrence of a tubing pressure which exceeds the pressure exterior of the tubing by a predetermined amount.

A further object is to provide a well tool of the character described wherein when the sleeve valve moves to open position it closes the main flow passage upstream of the bypass passage to ensure that the bypass passage will remain open.

Another object is to provide a well tool of the character described in which after the sleeve valve has been moved to open position, it cannot be returned to closed position responsive to differences between pressures in the tubing and pressures exterior thereof.

A further object of this invention is to provide a well tool of the character described having means therein for preventing flow from the interior of the tubing to the exterior thereof.

A further object is to provide a well tool of the character described having a check valve seat formed on the sleeve valve and surrounding the main flow passage and with a check valve closure engageable therewith for preventing back flow through the device, the check valve closure being biased towards the check valve seat by biasing means such as a spring.

Other objects and advantages will become apparent from reading the description which follows and from studying the accompanying drawings, wherein:

BRIEF DESCRIPTION OF THE DRAWING

FIGS. 1-A, 1-B, and 1-C, taken together, form a longitudinal view, partly in section and partly in elevation with some parts broken away, showing the device of this invention as it would appear during injection of chemicals or the like treating fluids, therethrough;

FIG. 2 is a cross-sectional view taken along line 2—2 of FIG. 1-C;

FIG. 3 is a cross-sectional view taken along line 3—3 of FIG. 1-C;

FIG. 4 is a view similar to FIG. 1-C but showing the device with the bypass open and the main flow passage closed;

FIG. 5 is a cross-sectional view taken along line 5—5 of FIG. 4;

FIG. 6 is a fragmentary view similar to FIG. 4 showing circulating fluids flowing through the device as they would from exterior of the tubing to the interior thereof;

FIGS. 7-A and 7-B, taken together, constitute a longitudinal view, partly in elevation and partly in section with some parts broken away, showing a modified form of the present invention; and FIG. 8 is a cross-sectional view taken along line 8—8 of FIG. 7-B.

DESCRIPTION OF THE PREFERRED EMBODIMENT

Referring now to FIGS. 1-A through 3 of the drawing, it will be seen that the flow control device of this invention is indicated generally by the reference numeral 10. While the device 10 may be anchored like a gas lift valve in sealing relationship in a well tubing (not shown) in any suitable manner such as, for instance, on an external lug mount, or in a bypass landing nipple such as the housing 10 shown in the aforementioned U.S. Pat. No. 2,726,723 to L. M. Wilhoit et al., it is particularly useful in side pocket mandrels such as the one shown schematically in aforementioned U.S. Pat. No. 3,993,129 and indicated generally therein by the reference numeral 12. In either case, the device of the present invention will be positioned to control entry of injection fluids from the exterior to the interior of the tubing in a manner to be explained.

The device 10 comprises a latch assembly 11 and a flow control device 12. The latch assembly 11 is a well-known device for anchoring gas lift valves in side pocket mandrels and is shown having its lower end attached to the upper end of the flow control device 12 as by threads as at 13. The latch assembly is provided with a locking lug 15 for releasably anchoring the device in the receptacle of a side pocket mandrel and is further provided with a running flange 16 by which the device is run into a well and with a pulling flange 18 by which the device is retrieved, all using well-known valve handling apparatus which includes a suitable kickover tool for aligning the handling tool with the offset receptacle of the side pocket mandrel.

Latches, such as the latch 11 and devices, such as the flow control device 12, as well as side pocket mandrels, are available from Otis Engineering Corporation, Dallas, Tex.

The flow control device 12 includes three portions: upper, intermediate, and lower. The upper portion comprises a valve mechanism for controlling injection of fluids, such as corrosion inhibitors, or other chemicals, into the well tubing from the exterior thereof at a very low rate. The intermediate portion comprises an initially closed, but openable, bypass which, when opened, permits high rate injection of fluids such as water or other kill fluids for killing the well. The lower portion of the device comprises a check valve mechanism for preventing back flow from interior of the tubing to the exterior thereof.

The device 12 includes a housing 20 comprising a packing sub 22 having its upper threaded end attached to the lower end of latch 11 as at 13 and its lower threaded end attached as at 24 to the upper end of valve housing 26. Housing 26, in turn, has its lower end threadedly attached as at 28 to bypass sub 30. Bypass sub 30 has its lower end threadedly attached as at 32 to check valve housing 34 whose lower end is closed by nose piece 36 attached as at 38 by a thread as shown. Nose piece 36 is provided with outlet openings 39 which communicate with the tubing interior.

Valve housing 26 is provided with a bore 40 which is reduced near its upper end and threaded as at 41 for a purpose to be described. Near its lower end, the valve housing 26 is provided with a pair of opposed inlet ports 42. Inlet ports 42 communicate with outlet openings 39 via a flow passage to be described. Below these inlet ports, housing bore 40 is enlarged to provide a downwardly facing shoulder 43.

A valve seat member 46 is disposed within valve housing 26 and has an external flange engaged with downwardly facing shoulder 43 to prevent upward movement of the seat member in the housing. A resilient seal such as o-ring 47 seals between the valve seat member and the housing below the inlet port 42 while another such seal ring 48 seals between these two pieces above the inlet ports. The valve seat member is reduced in outside diameter between the o-rings 47 and 48 as at 49 to provide an annular recess which communicates with the inlet ports 42 and with a cross passage 50 formed transversely through the seat member as shown.

A central longitudinal passage 52 is provided in the valve seat member 46 which extends from the cross passage 50 to the upper end of the valve seat member where it opens through a valve seat insert 54 having a seat surface 55 as shown. The seat insert 54 is preferably formed of a hard material such as tungsten carbide. Passage 52 communicates cross passage 50 with chamber 56 in housing bore 40 above valve seat member 46.

Valve seat member 46 is further provided with a plurality of offset longitudinal passages 58 (shown in dotted lines) which are disposed parallel to central passage 52 and extend the full length of the valve seat member to communicate chamber 56 with the region immediately below the seat member and which will be described later.

A valve ball 60, preferably of hardened material such as tungsten carbide, is attached, as by silver soldering, to piston 62 having an external annular recess formed thereabout in which a suitable resilient seal such as o-ring 64 sealingly engages the inner wall of chamber 56 so that fluids entering the valve housing through inlet ports 42 may pass into annular recess 49 and cross passage 50 and move upwardly through central passage 52 to lift valve ball 60 from engagement with seat surface 55. These fluids, when ball 60 is off seat, move into chamber 56 and then pass downwardly through offset passages 58. These fluids cannot pass upwardly beyond piston seal 64. The pressure of these fluids acting on the piston 62, when of sufficient magnitude, will lift the piston and the ball 60 carried thereon.

Piston 62 is reduced in diameter above seal 64 providing shoulder 65 forming a guide rod 66 which extends upwardly. A bearing ring 68 is supported on piston shoulder 65 and, in turn, supports the lower end of coiled compression spring 70 whose upper end bears against the lower side of flange 72 formed on guide 73, as shown, and this guide is engaged by the lower end of adjusting screw 74 which is received in thread 41 of packing sub 22 so that turning the adjusting screw in one direction will increase the compression in spring 70 and turning it in the other direction will reduce the compression. A screwdriver slot 76 may be provided in the outer end of screw 74 to facilitate the turning thereof. A lock nut 78 on the adjusting screw is tightenable against the upper end face of valve housing 26 to lock the adjusting screw against turning and to, thus, preserve the adjustment of the compression or load in spring 70 after it has been achieved. The spring thus biases the piston downwardly for the purpose of biasing the ball 60 towards sealing engagement with seat surface 55 of seal insert 54.

Thus, fluid pressure in chamber 56 applies an upwardly acting force to that area of the piston which is sealed by its o-ring 64 tending to lift the ball 60 above its seat. Of course, when the ball is on seat, pressure of the fluid in central passage 52 acts on a portion of the ball's surface tending to lift it off seat. Once the ball is off seat, the pressure in chamber 56 acts against the entire area sealed by o-ring 64. With the ball on seat, pressure in chamber 56 acts on that area sealed by o-ring 64 minus that area of the seat sealed by ball 60.

The chamber **56*a* above piston seal 64 and in which spring 70 is situated is normally filled with air at atmospheric pressure but could contain a suitable compressible gas at superatmospheric pressure, if desired. Such gas pressure would act on the upper side of the piston 62 and aid the spring 70 in biasing it downwardly. If desired, a small amount of lubricant and preservative such as water or other suitable medium may be deposited in chamber 56*a* where it will remain in contact with seal ring 64** to lubricate and preserve the same and, thus, prolong its useful life.

The upper end of adjusting screw 74 extends into bore **22*a* of packing sub 22, which bore is reduced as at 22*b* and is closed or left blind as at 22*c*. The threaded connection 24 is sealed by a suitable seal ring 25 as shown. Bore 22*a* communicates with chamber 56*a* through loose fitting thread 41. Thus, packing sub 22** effectively seals the upper end of chamber 56*a* with adjusting screw 74 inside.

Since the piston area sealed by seal ring 64 is quite large, the valve tip or ball 60 will be unseated by a relatively low pressure in chamber 56. To modify the device 12 for use in much higher pressures, the seal ring 60 may be eliminated so that no pressure differential will be developed across the piston. Thus, the valve tip will be lifted from seat surface 55 only by the force of fluid pressure in passage 52 in the valve seat 46. The valve is biased toward closed position only by the force of spring 70. The spring will thus maintain a back pressure on the chemicals or other fluids entering inlet ports 42.

Alternatively to eliminating seal ring 64, an equalizing passage (not shown) can be provided in piston 62 to conduct fluid pressures from below the piston into the chamber thereabove. In this case, the seal ring 64 may be left in place to prevent chattering of the valve. If so, the seal ring 64 need not fit tightly with bore 56 since it need not seal therewith. If the area sealed by the ball 60 when on seat is 3/16 square inch, then a spring force of 300 pounds will result in a valve opening pressure of 2716 pounds per square inch. Whereas, before such modification, if the diameter sealed by seal ring 64 was $1\frac{1}{8}$ inches, the area sealed would be 0.994 square inches, and a spring force of 300 pounds would result in a valve opening pressure of approximately 302 pounds per square inch.

Suitable seal means such as a V-packing set, indicated by reference numeral 80 surrounds the packing sub 22 and is supported on external annular upwardly facing shoulder 81 formed on the sub where its diameter is reduced to receive the annular packing. Packing set 80 is confined between shoulder 81 just mentioned and the lower end 11*a* of latch 11. Packing set 80 seals between flow control device 12 and the inner wall of the tubing receptacle (not shown, but which in this case would be the offset receptacle of a side pocket mandrel) at a location above the lateral ports of such side pocket mandrel.

A second V-packing set, indicated by reference numeral 80*a* is disposed about the bypass sub 30 as shown and its upper end is engageable by downwardly facing shoulder 82 formed on this sub where its diameter is reduced to receive this packing. The lower end of this packing set is supported by the upper end of check valve housing 34.

Bypass sub 30 is provided, just below the thread on its upper end, with bypass port means in the form of a multiplicity of lateral bypass ports 84 (see FIGS. 1-C and 5) which communicate the exterior of this sub with bore 86 interior thereof. Bore 86 is reduced as at 87 near its upper end, providing a shoulder 86*a*, and enlarged again as at 88 at its upper end as shown.

Valve seat member 46 is provided with a downwardly opening blind bore 89 which is equal in diameter to bore 87 of the bypass sub 30 and is axially aligned therewith, both of these bores being centered on the longitudinal axis of the device.

It will be noticed that enlarged bore 88 of the bypass sub communicates with the lower end of the offset passages 58 of the valve seat member 46. The purpose for this will later be made clear.

Bypass sleeve 92 is disposed within bypass sub 30 and initially closes or seals off bypass ports 84 but is movable to a position opening the same as will soon be described.

Bypass sleeve 92 is slidable in bore 86 of the bypass sub and has its diameter reduced as at 94 to provide shoulder 95 near its upper end. A seal ring such as o-ring 96 carried in a suitable seal ring groove near the upper end of reduced diameter portion 94 sealingly engages the wall of bore 87 of the bypass sub. Below the shoulder 95, the bypass sleeve is provided with a suitable seal ring recess in which a seal ring such as o-ring 97 is disposed to seal between the bypass sleeve and the bypass sub below bypass ports 84 as shown when the bypass sleeve is in its port-closing position. Thus, fluids entering through bypass ports 84 are confined in annular recess 98 provided as shown between the bypass sub 30 and bypass sleeve 92 and sealed at its upper and lower ends by seal rings 96 and 97, respectively, so long as the bypass sleeve remains in its closed position.

Bypass sleeve 92 has a bore 102 whose upper portion is reduced as at 104. In a transverse plane located slightly below its seal ring 97, the bypass sleeve 92 is provided with an appreciable number of bypass ports 110 which are registerable with bypass ports 84 of the bypass sub when bypass sleeve 92 is in its open position, shown in FIGS. 4 and 5. In order to make certain that bypass ports 84 and 110 will communicate freely when the bypass sleeve is in its open position, the bypass sub 30 is preferably formed with an internal recess such as recess 112 as seen in FIGS. 4 and 5. (Alternatively, a recess could be formed in the exterior surface of sleeve 92.) Then, if these ports do not align radially, they will nevertheless conduct fluids therethrough freely because both sets of ports communicate with recess 112. Thus, fluids entering the device through ports 84 flow into recess 112 and thence into and through ports 110.

Immediately below bypass ports 110, the bypass sleeve 92 is provided with a third o-ring 97*a* which is not unlike o-ring 97 but seals below the bypass ports as shown in FIG. 4.

The bypass sleeve 92 is held in its initially closed position by releasable means such as shear pins 114 and 115, one or both, which are disposed in suitable apertures in the wall of check valve housing 34 with their inner ends engaged in suitable recess means 116 and 117 formed in the exterior surface of bypass sleeve 92 near its lower end. These recess means 116 and 117 could be in the form of external annular grooves. Shear pins 114 and 115 are preferably retained by means such as the loose-fitting retaining sleeve 118 encircling the check valve housing 34 and confined between its upwardly facing shoulder 119 and packing set 80*a*. Thus, the shear pins cannot fall out in the well, yet they will be readily accessible for replacement by removing sleeve 118 during redressing of the device when the device is again on the surface.

By varying the size and quantity of the shear pins as well as the material from which they are made, such as aluminum, brass, steel, or the like, the shear means can be made to release at any suitable predetermined value.

The lower end of bypass sleeve 92 serves as a seat for check valve means which prevent back flow through the device regardless of the position of the bypass sleeve, in a manner which will now be described. Preferably, a check valve seat surface is formed about the extreme lower end of bore 102 of the bypass sleeve, and such surface is indicated by the reference numeral 120 in FIG. 6.

The check valve means comprises a check valve closure member 122 having a seal surface 124 formed thereon which is engageable with the seat surface 120 surrounding bore 102 to block backflow through the device. Check valve closure member 122 is movable between open and closed positions. It is provided with a blind bore 126 which opens downwardly and receives the guide rod 130 whose lower end is provided with fins 132 which rest on the floor 134 of the nosepiece 36. The fins extend below the lower end of guide 130 and permit fluid to flow between them and into outlet openings 39. A spring 138 is supported by the fins 132 and has its upper end bearing against the lower end of check valve closure member 122 thus to bias the closure member toward closed position. To aid in assembly, a pin 140 disposed in a suitable transverse aperture in the guide rod 130 has its outer ends engaged in one of a pair of opposed longitudinally extending slots 141 in the closure member to retain the closure member on the guide but otherwise serves no function after the device has been assembled.

Fluids passing downwardly through the bypass sleeve 92 will move the closure member 122 downwardly against the compression of spring 138 and permit such fluids to pass around the closure member 122 and spring 138, pass between the fins 132 and exit the device through outlet openings 39 to flow into the interior of the tubing. When such downward flow ceases, or when backflow develops, the spring 138 will move the closure into engagement with seat surface 120 to close the flow passage against backflow.

Of course, back pressure from the tubing presses the closure member 122 into intimate contact with seat surface 120 and tends to lift bypass sleeve 92, but the shear pins 114 and/or 115 prevent such sleeve movement. However, when the magnitude of this back pressure reaches sufficient value, the pins 114 and/or 115 will shear and bypass sleeve 92 will be forced from its closed position seen in FIG. 1-C to its open position seen in FIG. 4. This back pressure acts across the area sealed by o-ring 97*a*, that is, across the entire cross-sectional area of the bypass sleeve 92, since the bore 102 thereof is plugged by the closure member 122.

It will be noticed that when the bypass sleeve 92 moves from its closed position (FIG. 1-C) to its open position (FIG. 4), the small o-ring 96 near the upper end thereof moves out of bore 87 in the bypass sub, moves across annular recess 88 and sealingly engages blind bore 89 in the valve seat member 46. Fluids, then, can no longer flow through the offset passages 58 and into and through the bypass sleeve 92 because flow is blocked by o-rings 96 and 97 which seal above and below the recess 88, and fluids from passages 58 and recess 88 cannot enter the upper end of the bypass sleeve. Thus, the main passage through the device is closed above or upstream of the bypass passages when the bypass passages are opened. Additionally, fluids entering the device through inlet ports 42 can no longer lift valve ball 60 off its seat since the open bypass ports 94 and 110 offer a path of lesser resistance to flow.

The bypass sleeve 92 will remain in its open position shown in FIG. 4. The pressure of fluids entering bypass ports 84 acts equally against equally sized o-rings 97 and 97*a* and, thus, the forces resulting therefrom are equal and opposite and have no tendency to move the bypass sleeve from its open position.

Also, the pressure in chambers 56 and 98 are not sufficiently greater than the pressure in bore 102 of the bypass sleeve and, therefore, will not be effective to move the bypass sleeve from its open position.

Thus, when the bypass sleeve is open, fluids may flow freely from exterior of the tubing to the interior thereof through the aligned bypass ports 84 and 110, flow downwardly through the bypass sleeve, depress the check valve 122, flow between the wings 132 and exit the device through the outlet openings 39. Should flow cease or backflow conditions obtain, the check valve merely seats against the lower end of the bypass sleeve (FIG. 4) to prevent any backflow. High rates of flow can take place through the device when the bypass is open. During such high rates of flow, the check valve closure 122 may be depressed fully as seen in FIG. 6.

Upward movement of the bypass sleeve 92 is limited by engagement of its external upwardly facing shoulder 95 with the internal downwardly facing shoulder 86*a* in the bypass sub as seen in FIG. 4.

In use, the device 10 including a suitable anchoring device such as latch device 11 and flow control device 12 is lowered into a well on a running tool attached to a suitable tool string adapted for wireline or pumpdown operations and is installed in a suitable receptacle such as a side pocket mandrel which forms a part of the well tubing. The device is positioned in such receptacle so that its inlet ports 42 and bypass ports 84 communicate with the region exterior of the tubing and so that the outlet openings 39 communicate with the tubing interior. Treating fluids such as corrosion inhibitor, or other fluid chemical, is pumped down the well annulus outside the tubing at sufficient pressure to force ball 60 off seat and permit fluid flow through the valve at a low, probably very low, rate. When the pressure exterior of the tubing is sufficiently high, the valve will open to pass fluid. When this pressure falls below the predetermined value, the valve will close to prevent passage of fluids.

When it becomes desirable to kill the well or otherwise inject fluid into the tubing at a much higher rate of flow, the tubing is first pressured up to such extent that this pressure acting on the check valve and bypass sleeve will shear the shear pins and move the sleeve to a position opening the bypass, after which fluid may then be injected into the tubing through the device at the much higher rate. The device is retrievable using a tool train as before but equipped with a pulling tool which will engage the pulling flange 18 of latch 11, after which an upward force applied thereby will release lug 15 for rotation to unlocking position.

A modified form of the invention is shown in FIGS. 7-A, 7-B, and 8. In these figures, the device of this invention is indicated generally by the numeral 200. Like the device 12 of FIGS. 1-A through 6, it comprises a latch 11, which may be exactly like the latch 11 of the previous embodiment, or any suitable substitute therefor by which the device could be attached to a well tubing string so that it could control the injection of fluids into the tubing string from the exterior thereof. Attached to the lower end of latch 11 is a modified form of flow control device 212 which serves the same purposes as does the device 12 just described. The upper portion of the device constitutes a chemical injection valve which is capable of controlling injection of chemicals such as corrosion inhibitors, paraffin solvents, or the like, at very low rates of flow. The center or intermediate portion of the device provides a high capacity bypass passage which is initially closed by means which is movable when desired to an open position for injection of well treating or kill fluids into the tubing string at high rates of flow as for killing the well, or the like purpose. The lower portion of device 212 contains a check valve for preventing backflow through the device.

The flow control device 212 has a housing made up of several sections. The uppermost section of the housing is a packing mandrel 213 which is threadedly attached at its upper end to the lower threaded end 214 of the latch 11. A packing set 215 which may be exactly like the packing set 80 on the first embodiment is confined about the packing mandrel between an upwardly facing shoulder thereon and the lower end of the latch as shown. The lower end of the packing mandrel 213 is threaded as at 217 into the upper end of the bellows housing 218, and the lower end of the bellows housing 218 is threaded as at 220 onto the upper threaded end of the bypass sub 222 which is in turn threaded as at 224 into the upper threaded end of the check valve housing 226. The lower end of the check valve housing 226 is threaded as at 228 to the nose piece 230, which may be exactly like a nose piece 36 of the previous embodiment.

It will be noticed that the bellows housing 218 is provided with at least one, but preferably more, inlet ports 234, and that the nose piece 230 is provided with a plurality of outlet ports 236. A main flow passage which will be described later, is provided through the device extending from the inlet ports 234 to the outlet ports 236. Modified valve seat means 238 having a central passage 239 therethrough is provided with a hardened seat insert 240 having a seat surface 241 formed thereon surrounding the passage 239 which is engageable with the valve closure 242 carried on the lower end of valve member 244 attached to the lower end of bellows 246 whose upper end is attached as at 248 to the extreme lower end of the packing sub 213. Within and above the bellows 246 is a chamber 248 which is closed at its upper end by the lower end of the latch 11. This connection is sealed by the seal ring 250.

If desired, the chamber 248 may be filled with a charge of gas at superatmospheric pressure so that the force of this gas within the bellows tending to extend it will apply a bias thereto, tending to move the valve closure 242 into engagement with the seat surface 241 of the seat 238. Also, if desired, a coil spring 252 may be placed within the chamber 248 as shown with its upper end bearing against an adjusting screw 254 and its lower end bearing downwardly against the spring guide 256 which is in turn supported by a rod 258 which extends upwardly from the valve closure 244. The spring 252 will thus act to extend the bellows and apply thereto a downward bias tending to move the valve closure 242 toward the valve seat 241. Should a charge of gas be present in the chamber, then the force of the gas and the force of the spring will be additive, the two combining to apply a downward force tending to extend the bellows and close the valve. If desired, the spring can be used without the gas charge. On the other hand, if desired, the gas charge can be used without the spring. It would usually be desirable to use both.

It will be noted that the adjusting screw 254 is screwed into the thread at the upper end of the packing sub 213 and that this thread is sufficiently long to permit a wide range of adjustments so that the valve can be adjusted to respond to a wide range of predetermined pressures. Also, it will be noted that while the spring and/or gas pressure within the bellows chamber 248 applies a bias to the bellows tending to close the valve, the pressure of fluids entering the device through the inlet ports 234 surrounds the bellows and acts on its exterior surface tending to compress the bellows and thereby create a force tending to open the valve. At the same time, when the valve is closed, pressure within the passage 239 of the valve seat 238 also acts against that portion of the valve closure 242 which is exposed to pressures in the bore 239 of the valve seat 238 tending to lift the valve off seat.

When the pressure of fluids entering through inlet 234 reaches sufficient magnitude, the bellows will be compressed and the valve will lifted off the seat. Similarly, when such pressure decreases to a predetermined low value, the spring and/or charge pressure within the bellows will be sufficient to move the valve closure 242 into engagement with the valve seat to close the valve.

The passage 239 through the valve seat may preferably be quite small for very small rates of flow.

The bypass sub 222 is provided with a plurality of lateral ports 262, and these ports are located between the lower end of the bellows housing and the upper end of the lower packing section 215*a*, which packing section may be exactly like the packing section 215 previously described. This packing section is confined between a downwardly facing shoulder on the packing sub located immediately below the lateral ports 262 and the upper end of the check valve housing 226. These lateral ports 262 in the bypass sub provide a bypass passage from the exterior of the device to the interior thereof. It will be noticed that the bore 266 of the bypass sub is in direct communication with the bore 239 of the valve seat at its upper end, and that the bore 266 is in direct communication at its lower end with the bore 270 in the check valve housing. Thus, it is clear that a passage is provided between the inlet ports 234 and the outlet ports 236, and that fluids entering the bellows housing 218 through the inlet ports 234 may pass through the valve seat opening 239 through the bore 266 of the bypass sub and through the bore 270 of the check valve housing to arrive at the outlet ports 236, through which such fluids may exit into the tubing.

The bypass ports 262 of the bypass sub 222 are normally closed by means such as sleeve valve 272 which is initially disposed as shown with an imperforate portion thereof opposite the bypass ports 262 and has a pair of o-rings 273 and 274 sealing above and below the bypass ports 262, respectively. Another o-ring 275 is carried on the sleeve valve as shown for a purpose soon to be made known. The o-rings 273, 274, and 275 may be identical. Between the o-rings 274 and 275 the bypass sleeve is provided with a plurality of lateral ports 276 which can be placed in register with the bypass ports 262 of the bypass sub by moving the bypass sleeve upwardly in a manner soon to be described. The bypass sleeve is initially placed in the position as shown in FIG. 7-B, and its downward movement is limited by engagement of its lower end with the upwardly facing shoulder 278 in the check valve housing 226 while its upward movement is limited by a snap ring 280 carried in external annular recess 282 formed in the sleeve as shown. The snap ring is inherently sprung outwardly so that it will engage the recess 283 in the check valve housing but, due to the sloping surface 284 at its upper end, it is releasable when a sufficient upward force is applied to the sleeve as in a manner which is to be described. The bypass sleeve is movable to its upper position wherein its upper end engages the lower side of the valve seat 238 and wherein its lateral ports 276 are in registry with the bypass ports 262. In this position, the snap ring 280 is expanded inherently outwardly into engagement with the recess 285 and the square shoulder at the bottom end of the snap ring and the square shoulder at the bottom of the recess 285 coact to lock the bypass sleeve in port-opening position so that it cannot thereafter be returned to its port-closing position. When the bypass sleeve is in its open position with its ports registered with the bypass ports of the housing, fluids may be injected from the exterior of the device into the tubing through the bypass passages and into bore 277 of the bypass sleeve at considerably high rates.

The lower end of the bypass sleeve 272 is provided with a check valve seat surface 287 surrounding bore 277 which is engageable by check valve closure member 288 which is telescopingly mounted over a guide 289 having fins 290 thereon which rest on the floor 291 of the nose piece 230. A transverse pin 292 passes through the guide and has its ends disposed in elongated slots 293 formed in the check valve closure 288 as shown to limit the movement of the check valve relative to the guide during assembly and until the device has been assembled. If desired, a spring such as spring 294 may be placed around the guide and beneath the check valve closure member so that the spring, thus supported by the fins 290, will bias the check valve closure member 288 upwardly toward engagement with the check valve seat surface 287 on the lower end of the bypass sleeve. The length of the slots 293 in the check valve closure member is sufficient to assure that the check valve will engage the check valve seat surface even when the bypass sleeve is in its upper position, not shown.

In order to open the bypass through the flow control device, the pressure in the tubing is increased to press the check valve closure 288 upwardly against the lower end of the bypass sleeve with sufficient force to cause the snap ring 280 to be moved from lower recess 283 to upper recess 285 to position the bypass sleeve with its lateral ports 276 in register with the bypass ports 262. After the bypass sleeve has been moved to its open position, fluids may be injected from the exterior of the device into the tubing and past the check valve as desired. After the bypass sleeve has been shifted to open position, it will remain there, the snap ring being engaged in recess 285 preventing it from returning to closed position.

Thus, it has been shown that a device has been provided which is installable in and removable from a well using a tool string lowered into the well by a suitable well-known wireline or pumpdown method; that the device will control injection of fluids into the well tubing at a low rate of flow when the pressure of the fluid external of the tubing is of sufficiently high value; that when it is desired to inject fluids such as water or other kill fluids into the tubing at a much higher rate, the tubing pressure is increased above the pressure exterior thereof by a predetermined amount to open the bypass passage in the device to permit the injection of fluids into the tubing at a much higher rate to, for instance, aid in killing the well; that at either injection rate and with the bypass either open or closed, flow cannot be had through the device in a reverse direction (from tubing to casing); and that when the bypass passage is opened, the flow passage through the valve is automatically closed upstream thereof.

Further, it has been shown that a second form of the invention has been provided that serves the same purposes as does the previous embodiment; that fluids such as chemicals may be injected at very low rates through the upper portion of the valve which is controlled by the bellows and/or spring; and that when necessary the bypass through the valve may be opened to provide for injection of fluids such as kill fluids at a much, much higher rate.

Thus, it has been shown that the device of this invention fulfills all of the objects set forth in the beginning of this application and it is understood that changes in the shape, sizes, and arrangement of parts may be had by those skilled in the art without departing from the true spirit of this invention.

We claim:

1. A device for controlling flow between the interior and the exterior of a well flow conductor, comprising:

a. a housing connectable to said flow conductor and having inlet means and outlet means and a main flow passage connecting said inlet means with said outlet means;

b. annular valve seat means in said housing providing a seat surface surrounding said main flow passage;

c. valve means including a valve tip engageable with said seat surface for controlling flow through said seat;

d. a bypass passage communicating the exterior of said housing with said main flow passage at a location between said oulet means and said annular valve seat;

e. means initially closing said bypass passage and being movable to open position when the pressure at said outlet means exceeds the pressure at said inlet means by a predetermined amount; and f. valve means operator means, including:

i. means for biasing said valve tip towards a position of engagement with said seat surface, and ii. pressure responsive means for biasing said valve tip away from said seat surface when the pressure exterior of said housing reaches a predetermined value.

2. The device of claim 1, wherein said bypass passage includes port means in the wall of said housing and said means for initially closing said bypass passage is a sleeve valve in said housing and movable between port-closing and port-opening positions.

3. The device of claim 2, including:

seal means for sealing between said housing and said sleeve valve to prevent flow of fluids through said bypass passage.

4. The device of claim 3, wherein said seal means includes resilient seal rings sealing on longitudinally opposite sides of said bypass port means and the areas sealed thereby are not equal.

5. The device of claim 4, wherein the difference between the unequal areas sealed by said resilient seal rings is responsive to high pressure in said flow passage for moving said sleeve valve to port-opening position.

6. The device of claim 5, including:

releasable means holding said sleeve valve in its initial port-closing position and releasable to permit movement of said sleeve valve to port-opening position when pressure in said outlet exceeds the pressure exterior of said housing by a predetermined amount.

7. The device of claim 6, wherein said resilient seals comprise o-rings carried in suitable external annular recesses formed in portions of said sleeve valve having unequal diameters, and said releasable means comprises at least one shear pin engaged between said sleeve valve and said housing, said shear pin being fracturable when the pressure in said housing exceeds the pressure exterior thereof by a predetermined amount to release said sleeve for movement from port-closing to port-opening position.

8. The device of claim 7, wherein:

a. said sleeve valve has at least one lateral opening in the wall thereof alignable with said bypass port means when said sleeve valve is in port-opening position; and b. said o-rings carried on said sleeve valve includes a pair of o-rings for sealing on longitudinally opposite sides of said bypass port means, said pair of o-rings being of equal size.

9. The device of claim 8, including:

means on said housing and said sleeve valve means engageable to close said main flow passage at a location above said bypass port means when said sleeve valve means is in port-opening position.

10. The device of claim 9, including:

a. check valve seat means in said housing providing a check valve seat surface surrounding said main flow passage; and b. check valve means in said housing including a check valve closure engageable with said check valve set surface to prevent back flow through said flow passage.

11. The device of claim 10, wherein said annular check valve seat surface is formed on said sleeve valve means and said check valve means further includes means for biasing said check valve closure towards said check valve seat surface.

12. The device of claim 11, wherein said valve operator means for biasing said valve tip towards open and closed positions includes:

sealed chamber means in said housing spaced from said inlet port means on the opposite side thereof from said outlet port means and being plugged at one end and being sealed near its other end by a piston carrying a resilient seal engaged with the inner wall of said chamber, said chamber containing a compressible gas, said valve closure being connected with said piston, said piston being biased toward closed position by said compressible gas in said sealed chamber for biasing said valve tip towards said annular valve seat, said piston being exposed to pressure exterior of said flow conductor and being responsive thereto to move said valve closure means to open position.

13. The device of claim 12, further including:

a. spring means in said sealed chamber biasing said main valve closure means towards closed position; and b. means for adjusting the loading of said spring means to thereby adjust the pressure at which said main valve closure means is moved away from said main seat surface.

14. The device of claim 13, including:

lock means on said housing retrievably anchoring said device in locked and sealed relation in a receptacle forming a part of said flow conductor in said well.

15. The device of claim 14, wherein said means for closing said flow passage above said bypass port means when said sleeve valve means is in closed position includes:

a. said flow passage in said body having a portion thereof extending from the downstream end of the housing to a blind end located beyond said bypass port means and having an annular recess in its wall between said bypass port means and said blind end;

b. a cross passage in said body above said blind end having at least one of its ends communicating with said inlet port means;

c. a longitudinally directed central bore portion extending downwardly through said annular seat surface and communicating with said cross passage;

d. at least one longitudinally directed eccentric passage having one end thereof opening into said annular recess of said flow passage below said blind end and the other end thereof opening into said chamber below said piston, e. whereby when said sleeve valve moves to position opening said bypass port means, the smaller seal ring carried thereon is moved across said annular recess of said flow passage and is engaged in blind portion of said flow passage beyond said annular recess to close said flow passage.

16. A device for controlling flow between the interior and the exterior of a well flow conductor, comprising:

a. housing means connectable to said flow conductor and having inlet means and outlet means and a main flow passage connecting said inlet means with said outlet means;

b. annular valve seat means in said housing means providing a seat surface surrounding said main flow passage;

c. valve means including a valve tip engageable with said seat surface for controlling flow therethrough;

d. a bypass passage communicating the exterior of said housing means with said main flow passage between said valve seat means and said outlet means;

e. means initially closing said bypass passage and being movable to a position opening said bypass passage when the pressure at said outlet means exceeds the pressure at said inlet means by a predetermined amount; and f. valve means operator means, including:

i. bellows means having a pressure responsive surface and connected between said housing means and said valve tip, and ii. expansible means in said bellows applying a force to extend said bellows for moving said valve tip into engagement with said annular seat surface when said force of said expansible means exceeds the force of the pressure at said inlet means acting on said pressure responsive surface of said bellows, said bellows contracting to move said valve tip away from said seat means when the pressure acting on said pressure responsive surface of said bellows develops a force exceeding the force of said expansible means in said bellows.

17. The device of claim 16, wherein said bypass passage includes bypass port means in the wall of said housing means and said means for initially closing said bypass passage is a sleeve valve in said housing means movable between port-closing and port-opening positions.

18. The device of claim 17, including:

resilient seal means for sealing between said housing means and said sleeve valve to prevent flow of fluids therebetween.

19. The device of claim 18, including:

releasable means holding said sleeve valve in its initial port-closing position and releasable to permit movement of said sleeve valve to port-opening position when the pressure in said outlet exceeds the pressure in said inlet by a predetermined amount.

20. The device of claim 19, wherein:

a. said sleeve valve has at least one lateral part in the wall thereof registerable with said bypass port means when said sleeve is in port-opening position, and b. said resilient means for sealing between said housing means and said sleeve valve includes o-rings carried in external annular recesses on said sleeve valve and spaced to straddle said bypass port means in said housing means when said bypass sleeve is in said port-closing position.

21. The device of claim 20, including:

a. check valve seat means in said housing means providing a check valve seat surface surrounding said main flow passage, and b. check valve means in said housing means including a check valve closure engageable with said check valve seat surface to prevent backflow through said main flow passage.

22. The device of claim 21, wherein said annular check valve seat surface is formed on said sleeve valve means and said check valve means further includes spring means for biasing said check valve closure towards said check valve seat surface.

23. The device of claim 22, wherein said releasable means for holding said sleeve valve in its initial port-closing position includes:

a. a snap ring carried in an external annular recess on said sleeve valve and extending outwardly beyond the periphery thereof, said snap ring being contractable to a position wherein it does not extend beyond the periphery of said sleeve valve, and b. a first internal recess in said housing means initially engaged by said snap ring on said sleeve valve for holding said sleeve valve in said port-closing position and releasable to permit movement of said sleeve valve to port-opening position.

24. The device of claim 23, wherein said means for holding said sleeve valve further includes:

a second internal annular recess in said housing means spaced from said first internal recess and engageable by said snap ring for retaining said sleeve valve in said port-opening position.

25. The device of claim 24, wherein said expansible means in said bellows means is a compressible gas for extending said bellows means for biasing said valve tip towards said annular valve seat.

26. The device of claim 24, wherein said expansible means in said bellows means comprises spring means in said bellows for applying a force tending to extend said bellows for biasing said valve tip towards said valve seat.

27. The device of claim 26, including:

a. adjusting screw means for varying the compression in said spring means whereby said valve operator means is adjustable to respond to a pressure of predetermined value at said inlet means, and b. lock nut means for securing the position of said adjusting screw means for preserving the adjustment of said adjusting screw means.

* * * * *